United States Patent [19]

Wieland

[11] 4,092,043

[45] May 30, 1978

[54] LIMB SUPPORT APPARATUS

[76] Inventor: Roman G. Wieland, 8493 Innsdale S., Cottage Grove, Minn. 55016

[21] Appl. No.: 786,337

[22] Filed: Apr. 11, 1977

[51] Int. Cl.[2] ..... A47C 7/50

[52] U.S. Cl. ..... 297/429

[58] Field of Search ..... 297/429, 433–436, 297/DIG. 4

[56] References Cited

U.S. PATENT DOCUMENTS

| | | | |
|---|---|---|---|
| 3,376,067 | 4/1968 | Kernes | 297/429 X |
| 3,798,212 | 2/1974 | Suyetani | 297/429 |
| 3,990,744 | 11/1976 | Rodaway | 297/433 |

*Primary Examiner*—James C. Mitchell

*Attorney, Agent, or Firm*—Merchant, Gould, Smith, Edell, Welter & Schmidt

[57] ABSTRACT

Limb support apparatus for use on a wheel chair and which incorporates a positioning bracket slidably and rotatably movable from a fixed support position where it supports a foot or leg calf to an out of the way stowage position without requiring the movement of a leg being positioned on the wheel chair. Opposed flexible legs are rotatably and slidably movable over a base member to allow the positioning bracket to be easily maneuvered to a particular position and retained in such position by the biasing force of the flexible legs.

8 Claims, 6 Drawing Figures

LIMB SUPPORT APPARATUS

BACKGROUND OF THE INVENTION

1. Field of the Invention

Improved limb support apparatus usable on wheel chairs and the like which is slidable and rotatable to provide easy manuverability of the limb support from a support position to a stowage position.

2. History of the Prior Art

Various limb support devices and apparatus have long been utilized in conjunction with wheel chairs and other patient handling devices to support a patient's leg or foot. Because such devices are typically attached to a wheel chair or other patient support devices wherein the patient must be placed, it is necessary that the limb support apparatus allow the limb support surface to be moved from a support position to a stowage position. In the support position the limb support surface it placed such that it will bear the weight of the patient's foot or leg calf. In a stowage position, the limb support surface is positioned so that it is out of the way of the patient so that he can be placed in the wheel chair or other device without interference from the limb support surface.

In presently available apparatus, the limb support surface is typically moved from its support to its stowage position by rotating it about a fixed pivot point. In certain devices this movement requires that the limb support surface and its supporting apparatus be moved axially as well as pivotally from its stowage to its support position. For instance, when a wheel chair is being readied for a patient's use, the limb support surface is in its stowage position. The patient is then placed in the wheel chair and the limb support surface is moved to its support position beneath the patient's foot or leg calf. Present designs are inadequate in this regard because it is usually necessary to lift or move the patient's leg or foot out of its normal at-rest position while the limb support surface is moved from its stowage to its support position. Such movement may be very detrimental or dangerous in those instances wherein the patient's hip, leg or foot are injured or are in otherwise precarious conditions. In such situations it is desirable that no movement of the patient's leg or foot be made.

The undesirable situation noted above arises specifically in those instances wherein the design of the limb support apparatus only provides for pivoting of the support from a stowage to a support position. Since the limb support surface must pivot through a ninety degree angle or more to a position beneath the patient's foot or calf, there are no means for by-passing the patient's leg in making this position transition. Apparatus is presently unavailable which would allow a limb support surface to be moved from a stowage to a support position through a series of steps which would avoid movement of the patient's limb.

In addition to the detrimental effects resulting to the patient from the pivotal movement of a limb support surface from a stowage to a support position, many existing devices provide only a passive stowage of the limb support surface. In these instances, the limb support surface may merely hang loosely, generally beneath and behind the patient's limb position. In such instances, the freely movable limb support surface may randomly pivot to a position where it impacts or otherwise interferes with the patient's leg or other body portion. Thus, existing apparatus may not provide suitable means for fixedly retaining the limb support surface in a stowage position while at the same time allowing it to be safely moved from a stowage to a support position by simple hand motion.

SUMMARY OF THE INVENTION

Improved limb support apparatus for use on a wheel chair or other patient-supporting devices. The improved apparatus allows the patient's foot, leg calf or other portion to be supported by the apparatus while at the same time allowing the apparatus to be easily moved to a stowage position without the need of displacing the patient's leg which may result in injury or pain to the patient. The apparatus includes a limb support surface which is carried on a positioning bracket. The positioning bracket is pivotally and slidably attached to a base member which in turn is slidably positioned on a mounting arm attached to the wheel chair. The positioning bracket includes a restraining means at one end and clamp means at the opposite end. The restraining means include a retention member having side elements and an end element which fixedly engage the base member to hold it in place when the limb support surface is in its support position. The clamp means include opposed legs which may be manufactured from a flexible material which biases them to a static position. The legs are positioned on opposite sides of the base member and the base member has major and minor diameters such that when the positioning bracket is rotated from the minor diameter to the major diameter the legs flex and their biasing force holds the bracket in a stowage position on the base member.

Because the positioning bracket is slidable and rotatable it may be moved from its support position to its stowage position by merely sliding it laterally and then pivoting it outwardly away from the patient's limb. In this manner it is not necessary that the patient's limb be moved which may be difficult, painful or impossible in many instances wherein the patient's limb is injured or in a healing condition. This is in contrast to existing apparatus for limb support which require that the limb support be pivoted from a lateral position to a support position through the area in which the patient's limb is normally located when the patient is being placed in a wheel chair or removed therefrom.

THE DRAWINGS

DETAILED DESCRIPTION OF THE PREFERRED EMBODIMENT

Figures 1, 2, 3, 4, 5, 6:
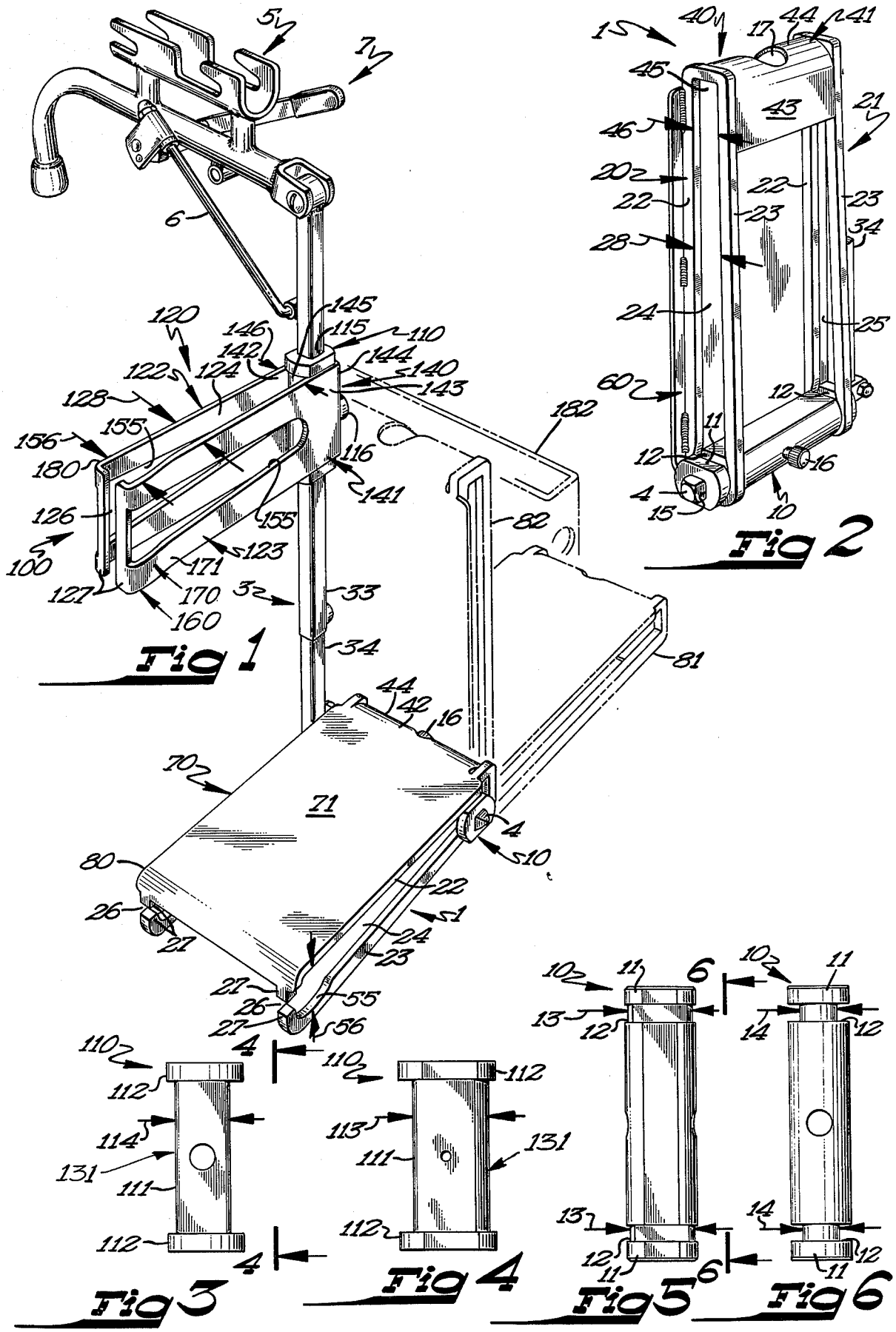
FIG. 1 is a perspective view of the present invention showing the first and second support apparatus attached to intersecting mounting arm.
FIG. 2 is a detailed perspective view showing the first support apparatus.
FIG. 3 is a detailed cross sectional view of the base member for the second support apparatus.
FIG. 4 is a detailed cross sectional view of the base member shown in FIG. 3 taken along the line 4—4.
FIG. 5 is a detailed cross sectional view of the base member for the first support apparatus.
FIG. 6 is a detailed cross sectional view of the base member shown in FIG. 5 taken along the line 6—6.

Referring to the FIGS. 1-6, wherein like numerals refer to like structural elements, the present invention incorporates first and second limb supporting apparatus, referred to by the numerals 1 and 100, respectively. While basic characteristics of the first and second limb support apparatus are identical, various details of their structure may vary and therefore in certain instances they will be described separately throughout this specification. However, various generic descriptions of the two apparatus may be utilized to describe either of apparatuses 1 or 100.

Referring first to the first limb support apparatus 1, shown in FIG. 1 and in detail in FIG. 2, it is comprised of a first positioning bracket 20 (and a second positioning bracket 21) which includes restraining means 40 located at one end of the positioning bracket and clamp means 60 located at the opposite end of the positioning bracket. In the preferred embodiment, the first and second positioning brackets 20 and 21 are identical and in various instances throughout this specification reference may be made to only one of them in describing the detailed construction of both.

Positioning brackets 20 and 21 support a foot panel 70, having a limb support surface 71 which extends between the first and second positioning brackets. The positioning brackets are supported on a first base member 10. It is intended that first and second positioning brackets 20 and 21 slidably and rotatably move with respect to base member 10. Base member 10 is in turn supported on a second mounting arm 4 which extends through an opening 15 in base member 10. Second mounting arm 4 is in turn connected to a first mounting arm 3 which attaches to a wheel chair or similar patient-support device (not shown) by means of an attachment device 5. In the preferred embodiment, first limb support apparatus 1 is intended as a foot support device. Second limb support apparatus 100 may be utilized in connection with the first limb support apparatus 1 and mounted on first mounting arm 3 to serve as a leg calf rest. The details of its construction and operation will be described subsequentally.

Referring to FIG. 2, the first and second positioning brackets 20 and 21 are each comprised of opposed first and second legs, 22 and 23 respectively, which are joined by a leg end element 2 at the end adjacent restraining means 40 and which are not joined together at the opposite end adjacent clamp means 60. As is shown in detail in FIG. 1, the open ends of legs 22 and 23 terminate in opposed lip elements, each designated by the numeral 27, which have an open gap 26 between them. Open gap 26 allows legs 22 and 23 to be moved toward one another or away from one another from their normal static position. As will be described in detail later, legs 22 and 23 are made from an elastically flexible material which allows them to be moved toward and away from the static position. In the preferred embodiment shown in the figures, legs 22 and 23 have a generally square cross section throughout their length. As will be described in detail later, this allows them to be firmly held in bracket indents 11 and 12 in which they slide and pivot.

First and second legs 22 and 23 enclose a guideway as guide opening, designated by the numeral 24 for first positioning bracket 20 and numeral 25 for second position bracket 21. This guideway has a width spanning the distance between legs 22 and 23 designated by the numeral 28, referred to as the opening width. Foot panel 70 may be welded or otherwise attached to first and second legs 22 and 23 to support the foot panel thereon.

In the preferred embodiment, base member 10 may generally be described as a spindle and has first and second bracket indents 11 and 12 respectively, located at opposed ends. A hole 15 extends through the length of base member 10 and provides a recess into which second mounting arm 4 may be slidably placed. A locating screw 16 allows base member 10 to be selectively positioned at a specified location along second mounting arm 4 so that foot panel 70 can be positioned toward or away from the patient's foot depending upon size requirements.

Referring to FIG. 1, located at the end of each pair of first and second legs 22 and 23 is a leg recess 55. It is the purpose of leg recess 55 to have the contour of at least a portion of first and second bracket indents 11 and 12 such that when base member 10 is positioned adjacent to recess 55 positioning brackets 20 and 21 will be in a biased position with the base member 10 positioned within leg recess 55 to hold first support apparatus 1 in a stowage position wherein it is generally vertically oriented relative to a horizontally oriented base member 10.

In the preferred embodiment, restraining means 40 on first support apparatus 1 is comprised of opposed first and second side elements, 42 and 43 respectively, and a retention member 41 spanning the side elements. This arrangement forms a U-shaped bracket which is generally rigid. Side elements 42 and 43 define a restraining recess 45 which has a recess width designated by the number 46. Side elements 42 and 43 and retention member 41 are affixed to the end portions of first and second leg elements 22 and 23 and because of the rigid nature of restraining means 40 the fixed portion of first and second legs 22 and 23 are held in a generally fixed position relative to one another. This provides a fixed restraining recess 45 which can be slideably moved over base member 10 and retained in a fixed position with regard to base member 10 when recess width 46 is generally identical to at least one diameter of bracket indents 11 and 12 on base member 10, as will be described in more detail subsequently. Thus, when restraining means 40 are moved such that they enclose base member 10, foot panel 70 is held in a generally fixed position relative to base member 10 and may support the weight of a patient's foot or leg without moving from the support position. This support position is shown by the heavy lines in FIG. 1. As is shown in the figures, a locating screw opening 17 is provided in end element 44. This opening allows a locating screw 16 on base member 10 to be turned while restraining means 40 are in their support position. Locating screw 16, by being tightened and loosened, allows base member 10 to be slidably moved along second mounting arm 4.

Base member 10 serves as the means for adjoining first support apparatus 1 in either a support or a stowage position (or intermediate position) which position may be selected by a hand motion of foot panel 70. In order to allow base member 10 to accommodate both restraining means 40 and clamp means 60, first and second bracket indents 11 and 12 each have a major and minor diameter, 13 and 14 respectively, as is shown in detail in FIGS. 5 and 6. Major diameter 13 is a diameter of the interior portion of bracket indents 11 and 12 and minor diameter 14 is smaller than major diameter 13 and is the diameter of the interior portion of brackets 11 and 12. Minor diameter 14 is generally perpendicular to major diameter 13. Major and minor diameters 13 and 14 generally form an interior portion of bracket indents 11 and 12 having a square cross section.

It is generally the purpose of major diameter 13 to facilitate the implementation of clamp means 60 when base member 10 is positioned within gap recess 55 of legs 22 and 23. As will be described in detail later, gap recess 55 has a static diameter designated by the numeral 56, which diameter may increase as legs 22 and 23 are spread as part of clamp means 60. In general, major diameter 13 is larger than static gap recess diameter 55.

Minor diameter 14 is intended to facilitate operation of restraining means 40. Generally, when restraining means 40 are operative base member 10 is positioned between first and second side elements 42 and 43. In this position first and second legs 22 and 23 are positioned within first and second bracket indents 11 and 12 with minor diameter 14 spanning recess width 46. Generally, minor diameter 14 is equal to recess width 46. This allows restraining means 40 to engage base member 10 when recess width 46 and minor diameter 14 correspond such that there is no pivotal movement between first support apparatus 1 and base member 10. This is the support position for foot panel 70. It should be noted that while first and second bracket indents 11 and 12 are narrow channels in the preferred embodiment, corresponding generally to the width of first and second legs 22 and 23, different types of recesses, having different shapes and widths may also be utilized (not shown) which correspond with operatively equivalent shapes and sizes (not shown) of legs 22 and 23.

Clamp means 60 are comprised of the unrestrained portion of opposed legs 22 and 23 and biasing means which, in the preferred embodiment, refer to structural properties of first and second legs 22 and 23 which allow them to elastically move toward and away from a static position wherein the width between them is defined by a static opening width 28. In other embodiments, (not shown) legs 22 and 23 may be biased by other means, e.g. discrete springs or discrete elastic material elements different from legs 22 and 23.

In the preferred embodiment, clamp means 60 include those flexible portions of first and second legs 22 and 23 which are removed from restraining means 40, in combination with biasing means which incorporate elastic flexibility in first and second legs 22 and 23. These properties allow base member 10 to be slidably moved between first and second legs 22 and 23. When this sliding movement takes place with minor diameter 14 of base member 10 aligned with opening width 28 and with minor diameter 14 equal to opening width 28, first and second legs 22 and 23 generally keep their static position and their elastic flexibility urges them toward their static position such that legs 22 and 23 abutably engage bracket indents 11 and 12. This abutting engagement allows first support apparatus 1 to be slidably moved from a support to a stowage position, in combination with pivoting movement, in a controlled manner. In addition, major diameter 13 is greater than gap recess diameter 56 and thus when first support apparatus 1 is positioned with base member 10 located in gap recess 55, major diameter 13 (greater than gap recess 56) forces first and second legs 22 and 23 from their static position in an elastic manner such that the legs bias themselves toward their static position and toward base member 10 to forcably engage base member 10. In this position first support apparatus 1 may be placed in a stowage position and retained there by the biasing means which incorporates the biasing force of elastically flexible legs 22 and 23. While these biasing means allow first support apparatus to be held firmly in its stowage position, out of the way of the patient's leg, this biasing force can be easily overcome by the use of hand force by the patient handler such that first support apparatus can be selectively and easily moved from its stowage position to its support position by overcoming the biasing force of flexible legs 22 and 23.

As is shown in the figures, first support apparatus 1 is moved from its support position (shown by solid lines) to a stowage position wherein it is generally perpendicular to the location in the support position, and is generally oriented upwardly from the support position. In certain instances it may also be oriented downwardly from this support position. In order to move first support apparatus 1 from its support to its stowage position, it is slidably moved laterally along base member 10 until base member 10 engages gap recess 55. At this point it is pivoted upward or downward such that major diameter 13 corresponds with gap recess diameter 56. In this position it is held in its fixed position by the biasing means. The intermediate position which is reached when first support apparatus is moved laterally, and prior to it being pivoted to its stowage position, is also shown by dotted lines in the figures.

Referring now to second support apparatus 100, it should be stated that much of the generic description utilized in the detailing of first support apparatus 1 is also applicable to second support apparatus 100. The basic elements of both first and second support apparatus 1 and 100 are identical with certain variations in details of the structure. However, either the detailed structure of the first or second support apparatus may be utilized in practicing this invention either as a leg calf rest or a foot rest. Second support apparatus 100 include a positioning bracket 120 which contains restraining means 140 and clamp means 160. Positioning bracket 120 is slidably and rotatably movable on a base member 110. In turn base member 110 may be slidably moved along a first mounting arm 3 which in turn attaches both to second mounting arm 4 and a wheel chair (not shown) by means of an attachment device 5.

Positioning bracket 120 is comprised of opposed first and second panels 122 and 123 respectively, which are joined on one end leg end element 144 and which have lip elements, each designated by the numeral 127, at one end of each of said first and second panels. Lip elements 127 are separated by a gap 126 and are unrestrained in that area. In the preferred embodiment, each of first and second panels 122 and 123 is generally rectangular in shape and each contains an opening 155 which is present for purposes of minimizing material and providing more flexibility to each of the panels.

Positioning bracket 120 includes clamp means 160 at the end where first and second panels 122 and 123 are separated and restraining means 140 at the opposite end. Positioning bracket 120 is pivotally and slidably movable with regard to base member 110 which in turn is slidable on first mounting arm 3. As is shown in detail in FIGS. 3 and 4, base member 110 is generally cylindrical in shape and has a bracket indent 111 formed by end elements, each designated by the numeral 112. Indent 111 serves much the same purpose as first and second bracket indents 11 and 12 on first support apparatus 1. Bracket indent 111 defines a hub 131 which is generally square in cross section defining a major diameter 113 and a minor diameter 114. Major diameter 113 is generally perpendicular to minor diameter 114 the purpose of which will be described subsequently. Base member 110 can be slidably moved along first mounting arm 3 by means of a hole therethrough designated by the numeral 115 through which first mounting arm 3 is moved. A locating screw 116 protruding through an opening in end element 114 allows base member 110 to be fixedly positioned at a selected location along first mounting arm 3. This allows second support apparatus 100 to be selectively, positioned to support the proper portion of the limb being positioned against the apparatus.

It is intended that second support apparatus 100 be slidably and rotatably moved from a support position, shown by solid lines in FIG. 1 to a stowage position, shown by dotted lines in FIG. 1. Restraining means 140 are provided to fixedly hold second support apparatus 100 in its support position. Restraining means 140 include opposed first and second retention members, 141 and 142, respectively which form a generally nonflexible portion of first and second panels 122 and 123, respectively. Retention members 141 and 142 are joined together by means of end element 144. Retention members 141 and 142 define a retention recess 145 having a recess width designated by their numeral 146. Recess width 146 is intended to be approximately equal to the minor diameter 114 of base member 110. Because retention members 141 and 142 are generally not flexible with regard to one another, when base member 110 is positioned between there is abutting engagement between restraining means 140 and base member 110 such that positioning bracket 120 is held in a fixed position. It should be noted that second panel 123 may serve as a calf panel 170 having a calf support surface 171. Alternatively, a separate calf panel may be affixed to the positioning bracket 120 (not shown).

Clamp means 160 include flexible portions of opposed first and second panels 122 and 123 and biasing means, which refer to the elastic flexibility of panels 122 and 123. In addition, a gap recess 155 may be provided in one of first and second panels 122 and 123 into which base member 110 may be inserted when second support apparatus is in its stowage position. Gap recess 155 is defined by a gap recess diameter 156 extending between recess 155 and the opposed surface of first panel 122.

First and second panels 122 and 123 have a biased static position wherein they are separated by guide opening 124 which has a width designated by the numeral 128. When panels 122 and 123 are moved apart from one another, the elastic flexibility of their material forces them toward one another. Thus, with opening width 128 being equal or larger than minor diameter 114 of base member 110, second support apparatus 100 may be slid along base member 110 in a controlled manner with engagement between the elements. Gap recess diameter 156 is larger than major diameter 114 of base member 110 and thus, when second support apparatus 110 is placed in its stowage position, the biasing force between the flexed panels 122 and 123 forcibly engage base member 110 firmly holding the support apparatus in its stowage position until moved by hand force.

Clamp means 160 and restraining means 140 allow second support apparatus 110 to be moved from its support to its stowage position without interferring with a patient's limb positioned there against. In particular, support apparatus 100 is moved from its support position by moving it laterally to an intermediate position (shown by dotted lines) in the figures, and then rotating it, with panels 122 and 123 flexing to rotate between minor diameter 114 and major diameter 113 of base member 110 to an at-rest position wherein it is perpendicular to the support position. In the at-rest position, support apparatus 110 may be positioned behind or forward of first mounting arm 3, although typically it would be positioned forward of 3 to avoid further interference with the patient's limb.

Various means of mounting first support apparatus 10 in combination with identical of differing support apparatus, such as support apparatus 100 may be utilized on a wheel chair or similar device. In the preferred embodiment, first mounting arm 3 is comprised of a housing portion 33 and a slide portion 34 which telescope relative to one another allowing the first support apparatus to be positioned at different heights to support patient's having different limb sizes. Various material may be utilized for the elements of the first and second support apparatus, although as had been pointed out an elastically flexible material should be utilized for first and second legs 22 and 23 and first and second panels 122 and 123. In a preferred embodiment, base member 110 and 10 are made from a nylon or plastic material which has good wear properties and which provide suitable movement interfaces between the moving parts.

While it has been noted that the foot support apparatus 1 may be stored in a position wherein it projects generally upwardly, but that it may also be stored in a position wherein it extends generally vertically downwardly, the applicant has found that it is preferable that it extend upwardly. In order to prevent the device from being moved to its downward stowage position, a bracket may be utilized below first support apparatus 1 to prevent a downward pivoting motion. Similarly, while it has been noted that the calf support apparatus 100 may be stowed with the support apparatus extending forwardly or rearwardly, the forward position is a preferable embodiment. To prevent the apparatus for pivoting rearwardly, a bracket may be utilized.

What is claimed is:

1. A limb support apparatus suitable for use on a patient-support device, which comprises:

(a) at least one mounting arm carried by the patient-support device;

(b) a limb support surface, said limb support surface having a support position wherein said limb support surface engages and supports the limb, an intermediate position transversely offset from said support position wherein said limb support surface is not in a supporting relationship relative to the limb, and a stowage position wherein said limb support surface is held out of engagement with the limb, said support and stowage positions being substantially perpendicular to one another;

(c) means for movably mounting said limb support surface on said mounting arm for both a transverse sliding and a pivoting movement relative thereto, said mounting means being configured to allow said limb support surface to be moved between its said support position and said stowage position by transversely sliding said limb support surface between said support and intermediate positions, and by rotating said limb support surface relative to said mounting arm between said intermediate and said stowage positions, whereby said limb support surface may be moved between said support position and said stowage position without moving the limb.

2. The limb support apparatus of claim 1, in which said mounting means comprises:

(a) a base member carried by said mounting arm;

(b) at least one positioning bracket attached to said limb support surface, said positioning bracket being movably mounted on said base member to movably mount said limb support surface relative to said mounting arm; and (c) said positioning bracket containing restraining means for fixedly engaging said base member in said support position of said limb support surface, and clamp means for yieldably engaging said base member in said stowage position of said limb support surface.

3. The limb support apparatus of claim 1 wherein said clamp means include:

(a) opposed legs positioned on opposite sides of said base member; and (b) biasing means forceably biasing said opposed legs toward one another to engage said base member thereby holding said positioning bracket in fixed relation relative to said base members until the force of said biasing means is selectively overcome.

4. The limb support apparatus of claim 3 wherein said biasing means comprise said opposed legs being elastically flexible about a biased static position wherein they define a guide opening there between defined in part by an opening width extending between said opposed legs.

5. The limb support apparatus of claim 3 wherein said restraining means include:

(a) side elements fixedly connected together and defining a recess having a generally fixed recess width between said side elements; and (b) said recess width being generally equal to the outside diameter of at least a portion of said base member to abutably receive said base member between said elements.

6. The limb support apparatus of claim 5 wherein said base member is defined at least in part by a first diameter and a second diameter which is generally perpendicular to said first diameter, and wherein said base member is rotatable relative to said positioning bracket between a first position wherein said first diameter spans the guide opening between said opposed legs and a second position wherein said second diameter spans the guide opening between said opposed legs, said first diameter being generally equal to or less than the guide opening between said opposed legs to allow said base member to be slidably moved between said clamp means and said restraining means, said second diameter being larger than the guide opening between said opposed legs to force said opposed legs to a position wherein said biasing means force the opposed legs to engage said base member holding it in said stowage position.

7. Limb support apparatus suitable for use on a patient-support device, which comprises:

(a) first and second mounting arms attachable to the patient-support device, said first and second mounting arms being attached to one another in a generally perpendicular relationship;

(b) first and second base members each being carried on one of said mounting arms;

(c) first and second positioning brackets;

(d) first and second limb support surfaces, each of said first and second limb support surfaces being attached to one of said first and second positioning brackets, each of said first and second limb support surfaces having a support position wherein said limb support surfaces engage and support the limb, an intermediate position transversely offset from said support position wherein said limb support surfaces are not in a supporting relationship relative to the limb, and a stowage position wherein said limb support surfaces are held out of engagement with the limb; and (e) means for movably mounting said positioning brackets on said base members for both a transverse sliding and a pivoting movement relative thereto, said mounting means being configured to allow said limb support surfaces to be moved from said support position to said stowage position by first transversely sliding said positioning brackets relative to said base members to move said limb support surfaces between said support and intermediate positions, and by rotating said positioning brackets relative to said base members to move said limb support surfaces between said intermediate and stowage positions, whereby said limb support surfaces may be moved between said support position and said stowage position without moving the limb.

8. The limb support apparatus of claim 7, wherein said first and second positioning brackets both have restraining means for fixedly engaging said base members in said support position of said limb support surfaces and clamp means for yieldably engaging said base members in said stowage position of said limb support surfaces.

* * * * *

UNITED STATES PATENT AND TRADEMARK OFFICE

CERTIFICATE OF CORRECTION

PATENT NO. : 4,092,043

DATED : May 30, 1978

INVENTOR(S) : Roman G. Wieland

It is certified that error appears in the above-identified patent and that said Letters Patent are hereby corrected as shown below:

In column 1, line 19 for "it" read --is--.

In column 8, line 2 for "of" read --or--.

In column 8, line 31 for "for" read --from--.

In column 9, line 16 for "members" read --member--.

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*